United States Patent [19]

Giambalvo

[11] Patent Number: 4,651,870

[45] Date of Patent: Mar. 24, 1987

[54] CONTROLLED INFUSION CONTAINERS AND METHOD OF MANUFACTURE

[76] Inventor: Frank Giambalvo, 200 Bayshore Rd., Bayshore, N.Y. 11706

[21] Appl. No.: 718,491

[22] Filed: Apr. 1, 1985

[51] Int. Cl.[4] ..... B65B 29/02

[52] U.S. Cl. ..... 206/0.5; 206/495; 426/82; 53/413

[58] Field of Search ..... 206/0.5, 495; 426/82, 426/83; 53/413, 455; 99/321, 322, 323

[56] References Cited

U.S. PATENT DOCUMENTS

| | | | |
|---|---|---|---|
| 1,665,080 | 4/1928 | Abbott | 426/82 |
| 2,006,036 | 6/1935 | Ware | 493/137 |
| 2,072,976 | 3/1937 | Andrus | 206/0.5 |
| 2,359,271 | 9/1944 | Sidebotham | 53/413 |
| 2,359,292 | 10/1944 | Barnett | 426/82 |
| 2,913,861 | 11/1959 | MacHeale | 53/473 |
| 3,257,212 | 6/1966 | Kasket | 426/82 |
| 4,141,997 | 2/1979 | Syroka et al. | 206/0.5 |
| 4,153,153 | 5/1979 | Herzog | 206/0.5 |
| 4,410,550 | 12/1983 | Gaskill | 206/0.5 |

FOREIGN PATENT DOCUMENTS

| | | | |
|---|---|---|---|
| 1111304 | 2/1956 | France | 99/323 |

*Primary Examiner*—William Price
*Assistant Examiner*—Brenda J. Ehrhardt
*Attorney, Agent, or Firm*—Sachs & Sachs

[57] ABSTRACT

A controlled infusion container suitable for infusing substances into a liquid into which it is immersed includes a container for the infusible material fabricated from porous sheet material folded upon itself providing a reservoir for the infusible material. The distal edges are folded upon themselves to form a relatively small overlap portion which is then sealed to provide a centrally disposed opening. A handle is inserted into the opening extending therein and is fastened to the remaining open edge of the container retaining the infusible substance therein. By inserting the assembly into a liquid and gently providing for up and down and lateral motion a pumping action created by the handle provides efficient infusion of the infusible substances into the liquid.

16 Claims, 9 Drawing Figures

CONTROLLED INFUSION CONTAINERS AND METHOD OF MANUFACTURE

BACKGROUND OF THE INVENTION

1. Field of the Invention.

The present invention relates to infusion packages, and in particular, to an infusion package capable of providing a pumping action when immersed in a liquid to improve the efficiency of the infusion process.

2. Discussion of the Relevant Art

The art abounds with different configurations for infusion packages, typical of which is U.S. Pat. No. 2,191,605 issued to L. L. Salfisberg on Mar. 5, 1940, which includes an infusion bag with a cover thereover that functions as both a handle and a hanger. In U.S. Pat. No. 2,291,278 issued to W. S. Cleaves on July 28, 1942, there is disclosed a tea or coffee bag including a porous infusion container and a handle affixed thereon. In another U.S. Pat. No. 2,359,292 issued to L. Barnett on Oct. 3, 1944, there is disclosed an infusion bag and handle suitable for tea or coffee wherein the handle may be folded over and cover the infusion bag. In U.S. Pat. No. 3,257,212 issued to M. Kasket on June 21, 1966, there is disclosed an infusion bag and handle assembly which provides for an auxiliary liquid pocket which attempts to overcome problems found in the earlier art by providing means for weighting down the infusion bag so that it stays in the bottom of a container of liquid.

In yet another U.S. Pat. No. 3,895,118 issued to A. Rambold on July 15, 1975, there is disclosed an infusion bag folded to provide multiple paths for the liquid into which the bag is to be immersed and a handle device affixed thereon which may be used to protect the infusion bag and suspend the bag from the edge of a container for the liquid, thus maintaining the bag containing the infusion material within the liquid to increase its efficiency.

The present invention overcomes the shortcomings found in the prior art by providing an efficient rapid means of increasing the ability of the liquid to come into contact with the infusion substances provided in the infusion bag and provides for a stirring motion while preventing the infusion bag from floating to the surface of the liquid into which it is immersed.

Therefore it is an object of the present invention to provide a controlled infusion container for infusible substances.

It is another object of the present invention to provide a controlled infusion container suitable for use with coffee, tea or the like.

It is yet another object of the present invention to provide a controlled infusion container that is more efficient and reduces the time of infusion of the infusible substances.

It is still yet another object of the present invention to provide a controlled infusion container that is inexpensive to manufacture and is readily disposable after use.

It is still yet another object of the present invention to provide a controlled infusion container that overcomes the shortcomings found in the prior art.

SUMMARY OF THE INVENTION

A controlled infusion container for infusible substances, according to the principles of the present invention, comprises in combination; a porous sheet material folded upon itself for holding infusible substances between the fold with a centrally disposed opening formed by the distal open edges of the material being aligned and sealed to provide a relatively small overlap portion. The overlap portion is sealed to retain the infusible substances therein. A handle is disposed within the opening and extends to the folded edge of the material and is fastened proximate the open edge thereof after folding or gathering the open edge, thereby further containing the infusible substances placed within the folded material.

A method for manufacturing controlled infusion container according to the principles of the present invention, comprises the steps of; providing porous sheet material, folding the sheet material to hold infusible material therebetween, folding the material to align the open distal edge thereof providing a relatively small overlap portion, fastening the material along the overlap portion to provide a centrally disposed opening, providing a handle, inserting the handle to extend within the opening, gathering the open edge of the material to conform to the size of the handle, and fastening the handle to the material proximate the open edge of the material.

The foregoing and other objects and advantages will appear in the description to follow. In the description, references are made to the accompanying drawing which now forms a part hereof, and in which is shown, by way of illustration, a specific embodiment in which the invention may be practiced. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENTS

Figure 1:
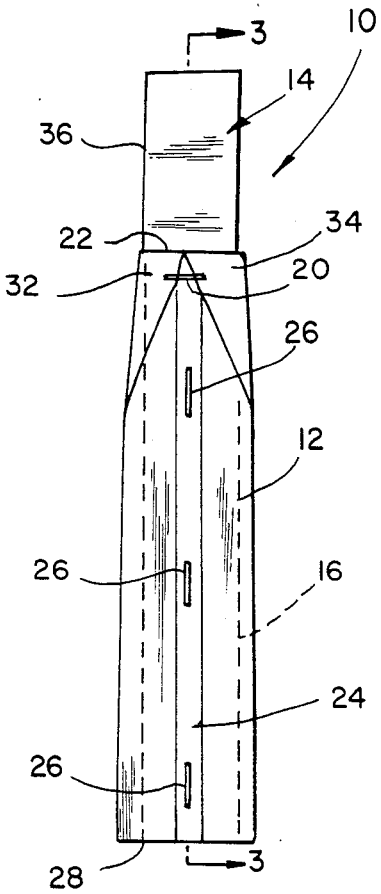
FIG. 1 discloses a front view in elevation of the controlled infusion container, according to the principles of the present invention.
Figure 2:
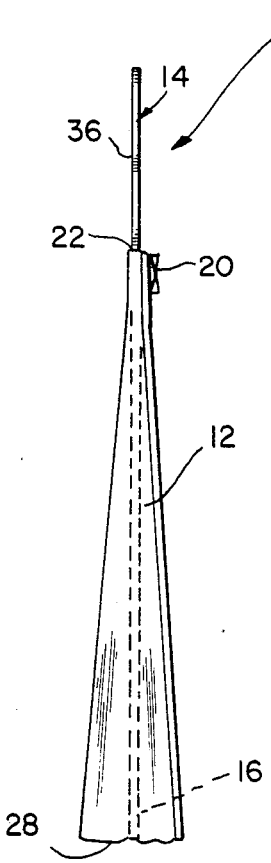
FIG. 2 shows a side view in elevation of the infusion container of FIG. 1.
Figure 3:
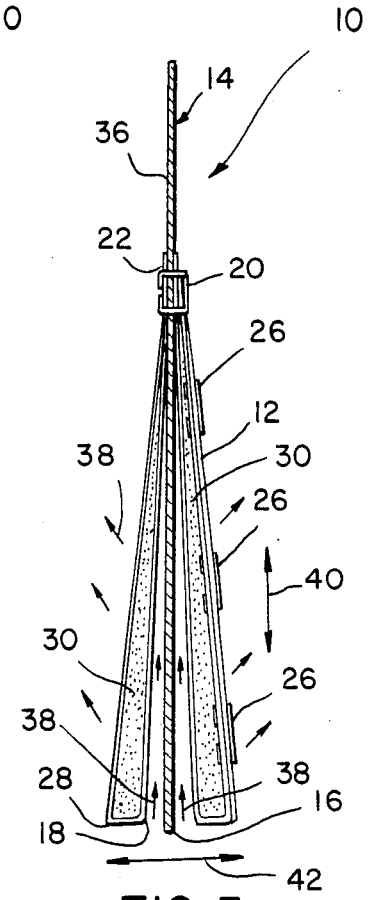
FIG. 3 is a cross-sectional view in elevation along the line 3—3 of FIG. 1.

Referring now to the drawing, and in particular, to FIGS. 1 through 3, there is shown a controlled infusion container 10 suitable for use with coffee, tea, or the like and includes a bag portion 12 fabricated from porous sheet material which is folded or prepared in accordance with the illustrations thereof shown in FIGS. 4, 5, 6 and 7, which will be explained in detail hereinafter.

Figure 9:
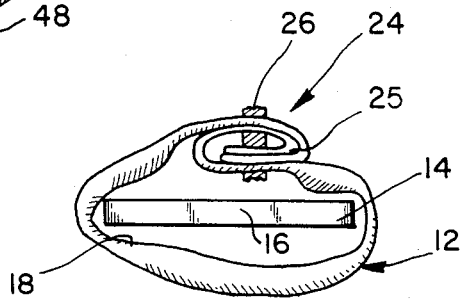
FIG. 9 is an enlarged pictorial representation of the bottom view of the infusion container as shown in FIG. 1 with the wrapped edge fold providing the overlap portion greatly enlarged for clarity.

The controlled infusion container 10 is further provided with a handle 14 preferably fabricated from a non-porous sheet material and has one end portion thereof 16 extend into the opening 18 formed by the bag portion 12 as will be described in detail hereinafter. The handle end portion 16 has the bag portion 12 affixed thereon, preferably by means of a staple 20 disposed proximate the open edge 22 of the bag portion 12, thereby retaining the bag portion 12 to the handle 14. The overlap portion 24 provided on the bag portion 12 may be sealed by using a wrapped edge fold 25, as shown in FIG. 9, and sealed or closed by means of staples 26. Preferably, the end portion 16 of handle 14 extends proximate the folded edge 28 of the bag portion 12. The infusion material 30 such as coffee or tea is held within the fold of the bag portion 12 by virtue of the staples 26 and the folds 32 and 34 provided at the open edge 22 to insure that the bag portion 12 fits snugly about the upper portion 36 of the handle 14.

Thus, in operation when the controlled infusion container 10 is immersed in a liquid container, not shown, the liquid will be caused to rise in the direction of arrows 38 (see FIG. 3) through opening 18, and exit through the porous bag portion 12 having traveled through the infusion material (coffee, tea, etc.) returning to the liquid in a rapid fashion having a path which encircles the handle 360 degrees. By a gentle movement of the infusion container 10, in the direction of arrows 40, a pumping action occurs with the liquid, causing the liquid to continually circulate and, with the aid of a small stirring action in direction of arrows 42, the pumping action is increased, thus improving the infusion efficiency of the container.

Preferably an individual, using the controlled infusion container, will continually hold on to the upper portion 36 of handle 40 during the pouring of the liquid into the container and thus, would not be confronted with the conventional paper tag falling into the liquid which would have to be retrieved. The stiffness provided in the non-porous material used for the handle 14 permits the infusion container 10 to be inserted into a container of liquid and may rest along the side of the container as the liquid is being poured therein without causing the handle to bend over and fall into the container, since the height of the container would generally be below the level of the handle 14. Once sufficient infusion has occurred, according to the users preference, the infusion container 10 may be removed from the liquid and disposed of.

The method of manufacturing a controlled infusion container according to the principles of the present invention, will now be described with reference to FIGS. 4 through 8.

Figure 4:
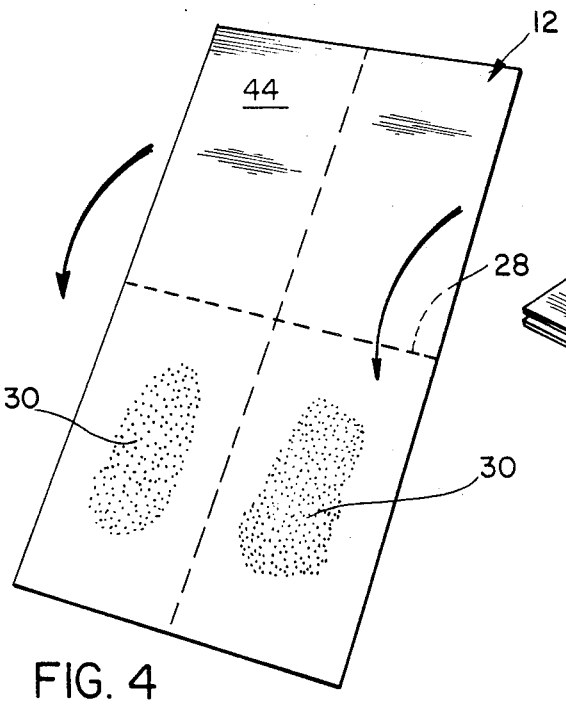
FIG. 4 is a pictorial representation of the sheet material with the infusion material positioned thereon.
Figure 5:
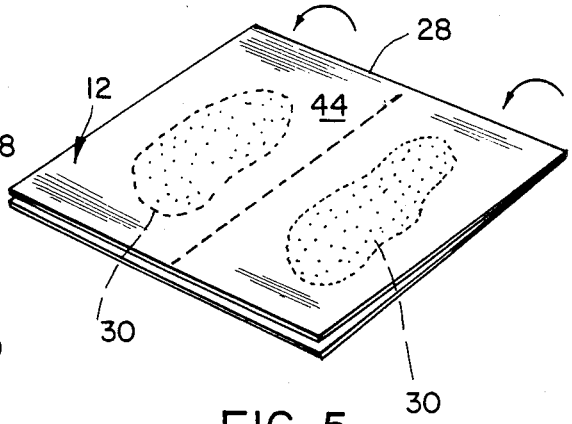
FIG. 5 is a pictorial representation of the sheet material folded to encompass the infusion material.
Figure 6:
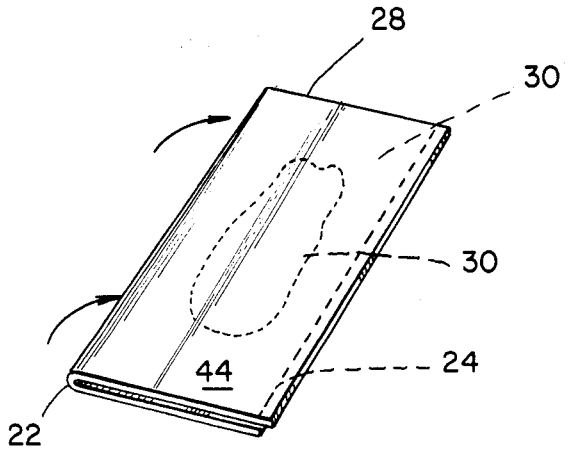
FIG. 6 is a pictorial representation of the sheet material folded again to provide an overlap portion.
Figure 7:
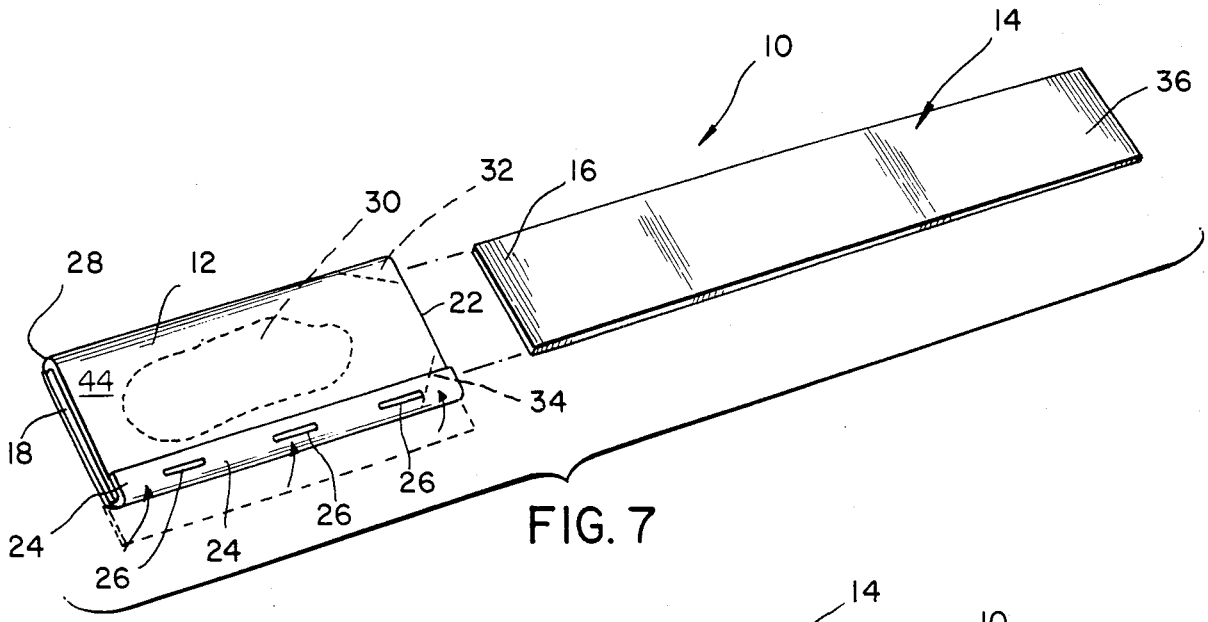
FIG. 7 is an exploded pictorial representation of the infusion container.
Figure 8:
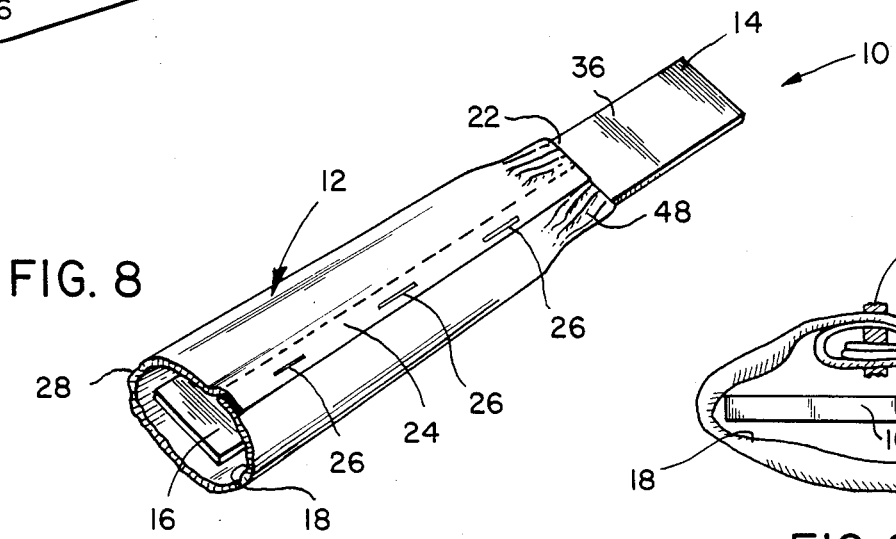
FIG. 8 is a pictorial representation of the complete infusion container disclosed in FIG. 1.

The piece of porous sheet material 44, preferably rectangularly-shaped is folded in half along the dotted line 28 which corresponds to the folded edge and the infusion material 30 is placed thereon as shown in FIG. 4. With the sheet material 44 folded as in FIG. 5 the infusion material 30 is encompassed between the fold of the material as shown. The sheet material 44 is folded again, as shown in FIG. 6, leaving a relatively small overlap portion 24 which may be sealed by a heat weld seam, serrated cold paper seam, or by using staples 26 as shown herein, thereby providing the opening 18. The open edge 22 may then be folded as at 32 and 34 (FIG. 7) or gathered 48, as shown in FIG. 8, in order that the opening 18 occurring at the open edge 22 will be decreased to conform with the width of the handle 14 so that when the bag portion 12 is affixed to the handle 14 the infusion material will be contained within the bag portion preventing any leakage therefrom. As explained earlier, the overlap portion may be formed, as shown in FIG. 9, to prevent a further sealing of the bag portion 12.

Hereinbefore has been disclosed a controlled infusion container suitable for use with coffee, tea, and the like, and a method of manufacture therefor, which is ideally suitable for unitary servings and is readily disposable. It will be understood that various changes in the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. A controlled infusion container for infusible substances comprising, in combination:

(a) a generally rectangular porous sheet material;

(i) said material having a first fold transversely along its longitudinal length for holding infusible substances, and (ii) an opening formed by a second fold perpendicular to said first fold with an overlap portion formed by longitudinal edges of said sheet;

(b) sealing means disposed along said edges of said overlap portion for retaining said infusible substances therein;

(c) handle means inserted within said opening at the end opposite said first fold; and (d) fastening means disposed proximate said opposite end for fastening said handle means to said folded material sheet and closing said opposite end.

2. A controlled infusion container according to claim 1 wherein said material is pervious to water.

3. A controlled infusion container according to claim 1 wherein said handle means is non-porous and relatively rigid.

4. A controlled infusion container according to claim 1 wherein said handle means is fabricated from non-porous sheet material.

5. A controlled infusion container according to claim 1 wherein said sealing means and said fastening means includes a plurality of staples.

6. A controlled infusion container according to claim 1 wherein said sealing means and said fastening means includes a heat weld.

7. A controlled infusion container according to claim 1 wherein said sealing means includes a cold paper weld and said fastening means includes a staple.

8. A controlled infusion container according to claim 1 wherein said handle means extends within said opening proximate the first folded edge of said material.

9. A controlled infusion container according to claim 1 wherein said handle means is narrower than said opening and said opposite end is gathered before being affixed to said handle means.

10. A controlled infusion container according to claim 1 wherein said handle means is narrower than said opening and said opposite end is folded to decrease said opening before being affixed to said handle means.

11. A controlled infusion container according to claim 1 wherein said overlap portion is provided by a wrapped edge fold.

12. The method of manufacturing a controlled infusion container comprising the steps of:

(a) providing a rectangular porous sheet material;

(b) folding said sheet material along a first line transverse to the longitudinal length to hold said infusion material therebetween;

(c) forming an opening by a second fold perpendicular to said first fold with an overlap portion formed by longitudinal edges of the material;

(d) fastening said material along said overlap portion to provide a centrally disposed opening;

(e) providing a handle means;

(f) inserting said handle means within said opening at the end opposite said first fold;

(g) gathering said opposite end of said material to conform to the size of the said handle means; and (h) fastening said handle means to said material means proximate said opposite end of said material.

13. The method according to claim 12 wherein step (g) is replaced by step (i) folding the open edge of said material means to conform to the size of said handle means.

14. The method according to claim 12 wherein said fastening in steps (d) and (h) is accomplished by using staples.

15. The method according to claim 12 wherein said handle is formed of non-porous sheet material.

16. The method according to claim 12 wherein the overlap portion is formed by a wrapped edge fold.

* * * * *